US005494382A

United States Patent [19]

Kloppers

[11] Patent Number: 5,494,382

[45] Date of Patent: Feb. 27, 1996

[54] DRILL BIT

[75] Inventor: Stephanus F. Kloppers, Postmasburg, South Africa

[73] Assignee: AMIC Industries Limited, Johannesburg, South Africa

[21] Appl. No.: 229,682

[22] Filed: Apr. 19, 1994

[51] Int. Cl.[6] ..... B25D 17/02

[52] U.S. Cl. ..... 408/226; 175/415; 408/199; 408/231

[58] Field of Search ..... 408/226, 227, 408/229, 231, 232, 199, 238, 239 R, 713; 175/414, 415, 417; 279/102, 103

[56] References Cited

U.S. PATENT DOCUMENTS

| | | | |
|---|---|---|---|
| 583,317 | 5/1897 | Wilson . | |
| 1,136,987 | 4/1915 | Wakfer . | |
| 2,156,287 | 5/1939 | Hokanson | 175/417 |
| 2,689,109 | 9/1954 | Curtis | 175/417 |
| 2,696,973 | 12/1954 | Baumgartner . | |
| 2,725,216 | 11/1955 | Brown | 175/417 |
| 2,733,943 | 2/1956 | Nater . | |
| 2,800,303 | 7/1957 | Dick | 175/415 |
| 2,807,443 | 9/1957 | Wyman . | |
| 2,890,021 | 6/1959 | Sandvig . | |
| 2,955,804 | 10/1960 | Feucht . | |
| 3,027,953 | 4/1962 | Coski . | |
| 3,336,081 | 8/1967 | Ericsson . | |
| 3,605,924 | 9/1974 | Donegan . | |
| 4,273,202 | 6/1981 | Phillips | 175/415 |
| 4,799,844 | 1/1989 | Chuang . | |

FOREIGN PATENT DOCUMENTS

| | | | |
|---|---|---|---|
| 2902258 | 7/1980 | Germany | 408/226 |
| 3513347 | 1/1987 | Germany | 408/199 |
| 66608 | 4/1983 | Japan | 408/199 |
| 1181428 | 2/1970 | United Kingdom . | |
| 1244275 | 8/1971 | United Kingdom . | |
| 1533786 | 11/1978 | United Kingdom . | |

*Primary Examiner*—Daniel W. Howell
*Attorney, Agent, or Firm*—Abelman, Frayne & Schwab

[57] ABSTRACT

A rotary or rotary/percussion drill bit 10 has a taper socket 14 in one end. A wall 18 bounds the socket 14. A plurality of recesses 20 is provided in the wall. In one embodiment, each recess 20 extends longitudially and resembles a flute. It has a valley 22 flanked by peaks 24. In another embodiment, the recesses may be circumferential, e.g. helical.

12 Claims, 2 Drawing Sheets

DRILL BIT

This invention relates to drilling equipment. More particularly, this invention relates to a drill bit suitable for rotary or percussion or rotary and percussion drilling.

According to the invention there is provided a drill bit which includes a body having a mounting socket with recesses, the socket being defined by a longitudinally extending wall which has a plurality of recesses.

The recesses may extend longitudinally for at least a part of the depth of the socket.

Instead, at least a part of the longitudinally extending wall defining the socket may have a series of generally circumferential grooves therein. The grooves may form a helix, screw thread fashion.

The recesses may preferably be in the form of or resemble flutes. Each flue may be defined by a valley which may have a peak defined on each opposed side thereof.

The socket may be tapered.

Preferably, the body is formed from a hardened and tempered metallic material.

The invention extends to a drill bit as herein described in combination with a shaft, a first end of the shaft being received in the socket and an opposed second end of the shaft being connectable to a drilling machine.

Where the socket is tapered, the first end of the shaft may be complementarily tapered to be received in the socket.

The Applicant believes that, in use, when the rotary/percussion drilling operation begins, some or all of the peaks of the flutes are plastically deformed, so that a greater surface area of contact is provided between the body and the shaft. Thus, attachment of the drill bit to the shaft is improved which in turn reduces the possibility of drill bits becoming detached from their associated shafts during the drilling operation.

The invention is now described, by way of example, with reference to the accompanying diagrammatic drawings.

Figure 1:
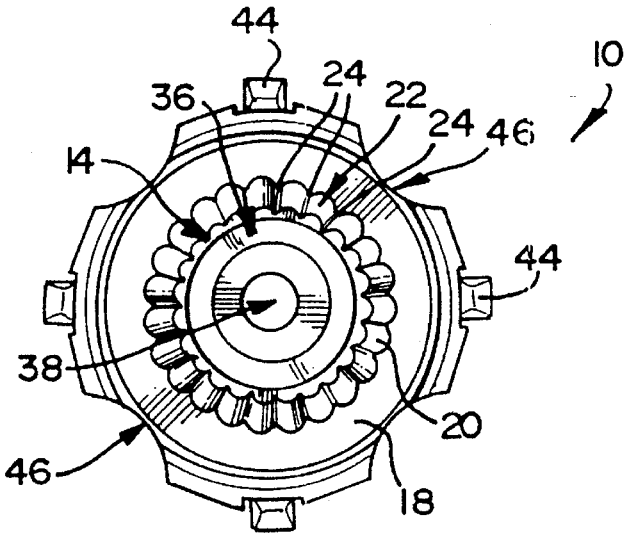
FIG. 1 shows a plan view of an operatively inner end of a first embodiment of a drill bit, in accordance with the invention.
Figure 2:
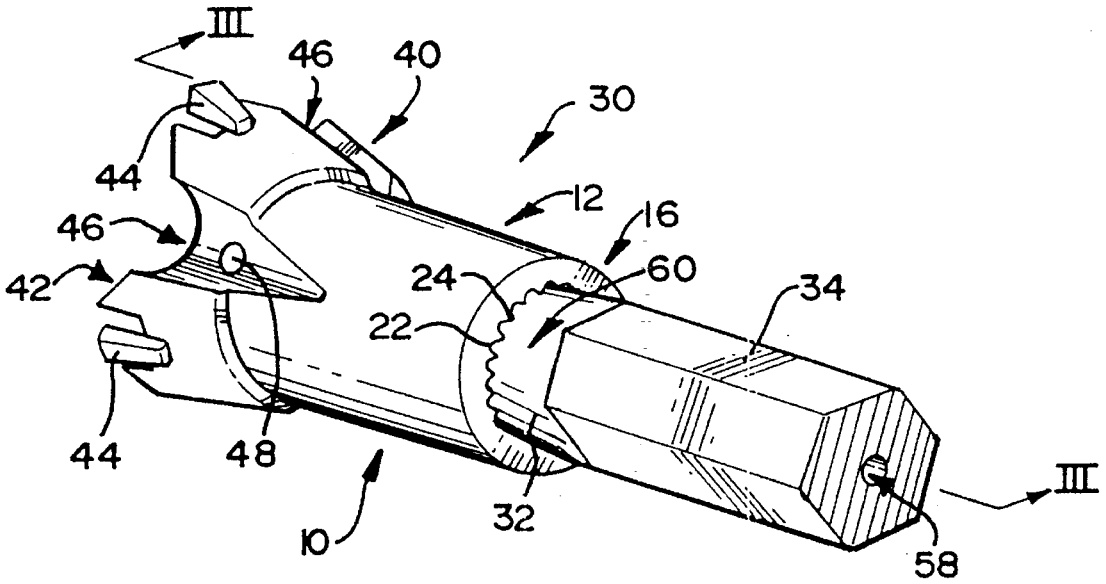
FIG. 2 shows a schematic view of the drill bit of FIG. 1 in combination with a shaft.
Figure 3:
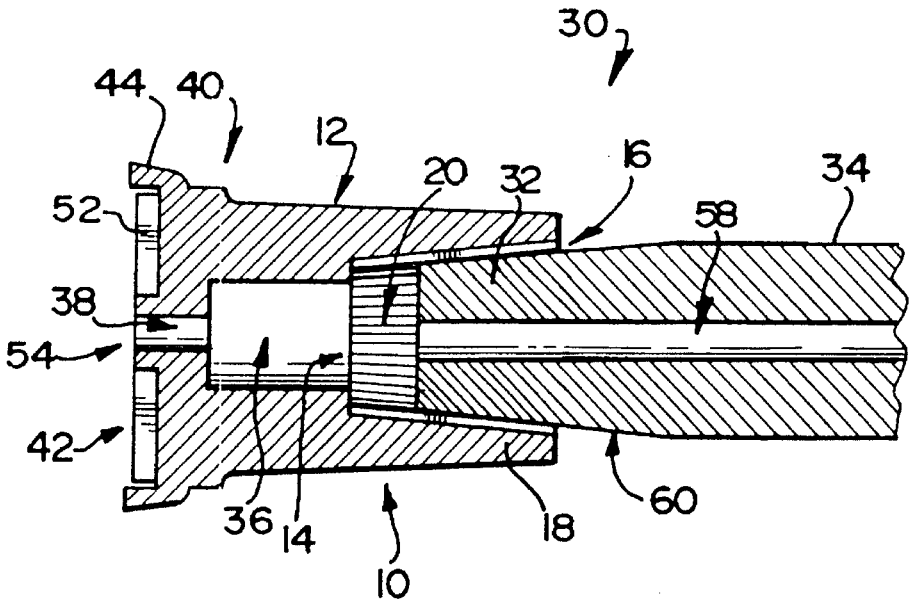
FIG. 3 shows a sectional side view of the drill bit of FIG. 1, in combination with a shaft, along lines III—III in FIG. 2.

Referring to FIGS. 1, 2 and 3 of the drawings, one embodiment of a drill bit in accordance with the invention is designated generally by the reference numeral 10.

The drill bit 10 includes a body 12 which has a socket 14 located in an operatively inner end 16 thereof. The socket 14 is defined by a longitudinally extending wall 18.

The drill bit 10 also includes a plurality of recesses 20 in the form of or resembling flutes in the wall 18. The flutes 20 extend longitudinally for at least a part of the depth of the socket 14. Each flute 20 is defined by a valley 22 which has a peak 24 defined on each opposed side thereof.

Referring to FIGS. 2 and 3, a combination of the drill bit 10, and a shaft 34, in accordance with the invention, is designated generally by reference numeral 30.

The socket 14 is tapered as shown in FIG. 3, so as to be able to receive a first end portion 32 of the shaft 34 which has a complementary taper.

The taper on the socket 14 is nominally 12 degrees whilst the complementary taper on the end portion 32 of the shaft 34 is 12 degrees±15 minutes.

The drill bit 10 has a cavity 36 located therein along a longitudinal axis thereof. The cavity 36 is adjacent the socket 14 and has a smaller cross-sectional area than the socket 14. The drill bit 10 also has a passage 38 which has a smaller cross-sectional area than the cavity 36 and is also located along the longitudinal axis thereof adjacent the cavity 36 on an opposed side of the cavity 36 to the socket 14.

The drill bit 10 has a crown portion 40 located at an end portion 42 thereof. The crown portion 40 has four bits 44 arranged symmetrically around a periphery thereof in a spaced relationship as shown in FIG. 1.

The crown portion 40 also has four hollows 46 located therein in a spaced relationship around the periphery thereof as shown in FIG. 1. The hollows 46 are arranged to be symmetrically located around the periphery with each hollow 46 being arranged between adjacent bits 44. Each hollow 46 extends longitudinally along the drill bit 10 and has a hole 48 located therein which connects with the cavity 36.

The end portion 42 has two channel-like grooves 52 located therein. The grooves 52 intersect each other perpendicularly at a mouth 54 of the passage 38.

The shaft 34 has a bore 58 therethrough along a longitudinal axis thereof.

In use, the end portion 32 of the shaft 34 is received in the socket 14 and an opposed second end portion (not shown) of the shaft 34 is connected to a drilling machine (not shown). When the rotary/percussion drilling operation begins, some or all of the peaks 24 of the flutes 20 are plastically deformed so that a greater surface area of contact and more intimate contact is provided between the wall 18 of the socket 14 and a surface 60 of the end portion 32 of the shaft 34. Thus, the attachment of the drill bit 10 to the shaft 34 is improved, which in turn reduces the possibility of the drill bit 10 becoming detached from its associated shaft 34 during the drilling operation.

During the drilling operation, water is injected through the bore 58 of the shaft 34, into the socket 14 and cavity 36 to flow out of the passage 38 and holes 48. This water circulates around the drill bit 10 and shaft 34 to effect cooling of the drill bit 10 and shaft 34.

The shaft 34 and the body 12 are formed from a hardened and tempered metallic material.

The Applicant believes that this invention may obviate the use of shim stock which is presently used to accommodate discrepancies between the taper at the end portion 32 of the shaft 34 and the taper in the socket 14 which may vary by approximately 2 degrees. The Applicant further believes that the flutes 20 may cause any dirt or other extraneous matter located between the wall 18 of the socket 14 and the surface 60 of the end portion 32 of the shaft 34 to be more easily removable, thereby to improve adhesion between the wall 18 of the socket 14 and the surface 60 of the shaft 34.

Figure 4:
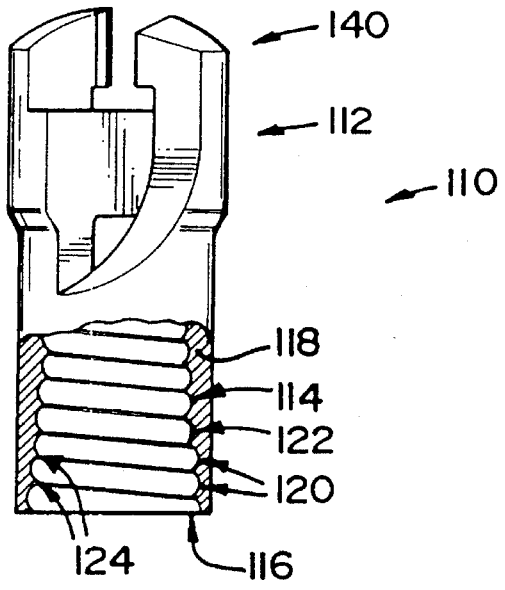
FIG. 4 shows, in axial section, a second embodiment of a drill bit in accordance with the invention.

With reference to FIG. 4, a second embodiment of a drill bit in accordance with the invention is generally indicated by reference numeral 110. The drill bit 110 is, in principle, similar to the drill bit 10 of FIGS. 1, 2 and 3 and is not again described in detail. Like reference numerals refer to like features. The drill bit 110 is especially suitable for use as a rotary drill bit.

The drill bit 110 is in the form of a body 112 having, at one end, a socket 114 formed therein. Toward an opposed end, it has a crown portion 140 which is generally known in the art and which is not described.

The socket 114 is formed in an operatively inner end 116 of the body 112. The socket 114 is formed by a longitudinal and circumferential wall 118. The socket 114 is generally taper at nominally 12°.

In accordance with the invention, helical fluting 120 is formed internally in the socket surface. The fluting is in the form of a helical flute of which portions are shown at 122 in FIG. 4. Each portion 122 is flanked by peaks 124, each peak 124 being intermediate portions 122 of the flute. The direction or "hand" (i.e. left hand or right hand) of the helical flute is selected such that, bearing in mind the direction of rotation of a rotary drill driving the drill bit in use, the rotation of the rotary drill will enhance securing of the drill bit to a shaft via which it is attached, to the rotary drill.

The material of the body 112, and more specifically the longitudinal, peripheral wall 118, is hardened and tempered steel.

As was described with reference to FIGS. 1, 2 and 3, a shaft such as the shaft 34 having a tapered end portion 32 is receivable within the socket 114. When thus received, the peaks 124 deform plastically to take up any irregularities and to make provision for manufacturing tolerances in the taper portion 32 such that the taper portion 32 is supported, intermittently by the deformed peaks, along the whole of its circumference, and substantially the whole of its length. Such receipt and deformation of the peaks take place initially when drilling with the drill bit commences, and deformation of the peaks continues progressively until receipt is stabilized.

It is a first advantage that contact between the socket 114 and the taper portion 32, albeit intermittently, takes place over a large area i.e. substantially spread over the whole of the area of the taper portion 32 as explained above. It is thus envisaged that receipt of the taper portion 32 within the socket 114 is more stable than in known art drill bit and drill shaft combinations.

It is further an advantage that, because the bearing surface of the socket 114, although spread out over a relatively large area, is in fact relatively small thus allowing plastic deformation to take place and thus allowing surface irregularities and manufacturing tolerances to be taken up thus ensuring a stabilized and rigid fit. Simultaneously, it allows manufacturing tolerances to be relaxed.

It is also believed that the peaks 124 will be able to cut through dirt, scale, or the like on the surface of the taper portion thus ensuring an intimate fit to the mother material of the shaft. Furthermore, rotation in use will enhance securing of the drill bit to a shaft, as described above.

It is yet a further advantage, so the Applicant believes, that replacement of the drill bit is facilitated in that the helical fluting facilitates removal of a spent or blunt drill bit from the shaft.

I claim:

1. A drill bit which includes a body which has a mounting socket having a mouth towards an end of the body, the socket being defined by a wall of round female frusto-conical shape tapering from the mouth inwardly, the wall having a plurality of recesses formed and arranged to leave intact internal ridges or peaks coinciding with said round female frusto-conical shape, the body being of hardened and tempered metal to render the ridges or peaks plastically deformable to enhance frictional receipt of the body over a complementally round frusto-conical shaft.

2. A drill bit as claimed in claim 1 in which the recesses are of curved concave cross-sectional shape resembling flutes, the peaks or ridges having correspondingly curved, concave sides rendering the ridges or peaks narrower than the recesses.

3. A drill bit as claimed in claim 1 in which said internal ridges or peaks extend longitudinally.

4. A drill bit as claimed in claim 1 in which said internal ridges or peaks extend circumferentially.

5. A combination of a shaft having a frusto-conical end portion of round cross-section and smooth surface; and a drill bit which includes a body which has a mounting socket having a mouth toward an end of the body, the socket being defined by a wall of round female frusto-conical shape tapering from the mouth inwardly and being complemental to and receivable over said end portion of the shaft, the wall having a plurality of recesses formed and arranged to leave intact internal ridges or peaks coinciding with said round female frusto-conical shape to interface with said smooth surface of the end portion of the shaft, the body being of hardened and tempered metal to allow plastic deformation of the ridges and peaks against said smooth surface in use.

6. A combination as claimed in claim 5 in which the recesses are of curved concave cross-sectional shape resembling flutes, the ridges or peaks having correspondingly curved, concave sides rendering the ridges or peaks narrower than the recesses.

7. A combination as claimed in claim 5 in which said internal ridges or peaks extend longitudinally.

8. A combination as claimed in claim 5 in which said internal ridges or peaks extend circumferentially.

9. A combination of a shaft having a frusto-conical end portion of round cross-section and smooth surface; and a drill bit which includes a body which has a mounting socket having a mouth toward an end of the body, the socket being defined by a wall of round female frusto-conical shape tapering from the mouth inwardly and being complemental to said end portion of the shaft, the wall having a plurality of recesses formed and arranged to form internal ridges or peaks coinciding with said round female frusto-conical shape, the body being of hardened and tempered metal., the end portion of the shaft being forcefully, frictionally received within said mounting socket, such that said ridges or peaks interface under plastic deformation with said smooth surface of the end portion of the shaft.

10. A combination as claimed in claim 9, in which said plastic deformation of the ridges or peaks varies in degree from one position to another to accommodate surface irregularities of said smooth surface.

11. A combination as claimed in claim 9, in which said plastic deformation of the ridges or peaks varies in degree from one position to another to compensate for manufacturing inaccuracies in said end portion of the shaft.

12. A combination as claimed in claim 9 in which the recesses are of curved, concave cross-sectional shape resembling flutes, the ridges or peaks having correspondingly curved concave sides rendering the ridges or peaks sharp, in which combination said ridges or peaks cut through relatively soft foreign matter on said smooth surface.

* * * * *